US005937642A

United States Patent [19]

Magarida et al.

[11] Patent Number: 5,937,642

[45] Date of Patent: Aug. 17, 1999

[54] EXHAUST MANIFOLD

[75] Inventors: Naofumi Magarida, Susono; Makoto Suzuki, Mishima, both of Japan

[73] Assignee: Toyota Jidosha Kabushiki Kaisha, Toyota, Japan

[21] Appl. No.: 08/922,340

[22] Filed: Sep. 3, 1997

[30] Foreign Application Priority Data

Sep. 13, 1996 [JP] Japan ..... 8-243008

[51] Int. Cl.[6] ..... F01N 7/10

[52] U.S. Cl. ..... 60/323; 60/322

[58] Field of Search ..... 60/323, 322, 300

[56] References Cited

U.S. PATENT DOCUMENTS

| | | | |
|---|---|---|---|
| 4,372,112 | 2/1983 | Ackerman et al. | 60/323 |
| 5,572,868 | 11/1996 | Okamoto et al. | 60/323 |
| 5,706,655 | 1/1998 | Kojima et al. | 60/322 |

FOREIGN PATENT DOCUMENTS

| | | |
|---|---|---|
| 92-14166 U | 2/1994 | Germany . |
| A-1-12021 | 1/1989 | Japan . |
| 5-78917 U | 10/1993 | Japan . |
| 6-76620 U | 10/1994 | Japan . |
| A-8-189353 | 7/1996 | Japan . |

*Primary Examiner*—F. Daniel Lopez
*Assistant Examiner*—Binh Tran
*Attorney, Agent, or Firm*—Oliff & Berridge, PLC

[57] ABSTRACT

An exhaust manifold 10 is adapted for being mounted between a cylinder head and an exhaust pipe and has a plurality of branch pipes 12, 14, 16, 18 arranged in the longitudinal direction of the cylinder head. The exhaust manifold 10 also has a confluence 20 placed downstream the branch pipes 12, 14, 16, 18. The branch pipes 12, 14, 16, 18 join the confluence 20 which has a plurality of junctions 22, 24, 26. Each junction is formed with two adjoining branch pipes and provided with a cylinder head side portion 28, 30, 32 facing toward the cylinder head. The thickness of each cylinder head side portion is larger than the thicknesses of portions excluding the cylinder head side portions in the exhaust manifold, and the thickness 36 of the cylinder head side portion 30 arranged in the middle of the longitudinal direction of the cylinder head is the largest in the thicknesses 36, 38 of all of the cylinder head side portions 28, 30, 32. The exhaust manifold 10 can withstand the compressive stresses caused by the thermal expansion and can have less weight.

3 Claims, 4 Drawing Sheets

EXHAUST MANIFOLD

BACKGROUND OF THE INVENTION

1. Field of the Invention

The present invention relates to an exhaust manifold for directing an exhaust gas from each cylinder of a multiple cylinder engine to an exhaust pipe.

2. Description of the Related Art

As is known in the prior art, an exhaust manifold is used as an exhaust part for directing an exhaust gas from an engine for an automobile to an exhaust pipe. The exhaust manifold thermally expands because a hot exhaust gas passes from the engine to the exhaust manifold. However, since a flange portion in the exhaust manifold is secured a cylinder head with bolts, the exhaust manifold cannot freely thermally expand, therefore compressive stresses occur at some portions in the exhaust manifold. In particular, the compressive stresses occur at branch pipes secured to the cylinder head and cylinder head side portions in junctions, each junction being formed with two adjoining branch pipes. Japanese Unexamined Utility Model Publication (Kokai) No. 6-76620 discloses an exhaust manifold in which the thicknesses of the branch pipes and the cylinder head side portions are larger than the thicknesses of portions excluding the branch pipes and the cylinder head side portions in the exhaust manifold, so that the branch pipes and the cylinder head side portions can sufficiently withstand the compressive stresses.

As described in Japanese Unexamined Utility Model Publication (Kokai) No. 6-76620, the exhaust manifold of the prior art has a plurality of branch pipes and cylinder head side portions arranged in the longitudinal direction of the cylinder head, in which all of the thicknesses of the branch pipes and the cylinder head side portions are the same. However, the stresses which occur at the branch pipes and the cylinder head side portions are not the same. The stress which occurs at the cylinder head side portion arranged in the middle of the longitudinal direction of the cylinder head is the largest. The stress which occurs at the branch pipe decreases in proportion to an increase of the distance between the branch pipe and the middle of the longitudinal direction of the cylinder head. The stress which occurs at the cylinder head side portion decreases in proportion to an increase of the distance between the cylinder head side portion and the middle of the longitudinal direction of the cylinder head. The stress which occurs at the branch pipe decreases in proportion to a decrease of the distance from the cylinder head to the branch pipe. That is, the thicknesses of the branch pipes and the cylinder head side portions arranged far from the middle of the longitudinal direction of the cylinder head are unnecessarily large, and the thicknesses of the branch pipes arranged close to the cylinder head are unnecessarily large, so that the total weight of the exhaust manifold of the prior art is unnecessarily large.

SUMMARY OF THE INVENTION

An object of the present invention is to provide an exhaust manifold which can withstand the compressive stresses occurring at the branch pipes and the cylinder head side portions and caused by the thermal expansion of the exhaust manifold and which can reduce the weight and the manufacturing cost by reducing the amount of material.

An another object of the present invention is to provide an exhaust manifold which can reduce the stresses transmitted to a flange integrally formed with the branch pipes, caused by the thermal expansion of the exhaust manifold.

The present invention provides an exhaust manifold adapted for being mounted between a cylinder head and an exhaust pipe, comprising:

a plurality of branch pipes arranged in the longitudinal direction of the cylinder head and adapted for being connected to the cylinder head;

a confluence placed downstream the plurality of branch pipes and adapted for being connected to the exhaust pipe, the plurality of branch pipes joining the confluence, the confluence having a plurality of junctions, each junction being formed with two adjoining branch pipes and provided with a cylinder head side portion facing toward the cylinder head;

the thickness of each cylinder head side portion being larger than the thicknesses of portions excluding the cylinder head side portions in the exhaust manifold; and the thickness of the cylinder head side portion arranged in the middle of the longitudinal direction of the cylinder head being the largest in the thicknesses of all of the cylinder head side portions.

The exhaust manifold can withstand the compressive stresses occurring at the cylinder head side portions which are larger than the compressive stresses occurring at the portions excluding the cylinder head side portions, because the thicknesses of the cylinder head side portions are larger than the thicknesses of the portions excluding the cylinder head side portions in the exhaust manifold. Further, the exhaust manifold can withstand the compressive stress occurring at the cylinder head side portion arranged in the middle of the longitudinal direction of the cylinder head which is the largest in the compressive stresses occurring at the cylinder head side portions arranged in the longitudinal direction of the cylinder head, because the thickness of the cylinder head side portion arranged in the middle of the longitudinal direction of the cylinder head is the largest in the thicknesses of the cylinder head side portions arranged in the longitudinal direction of the cylinder head. Now, "portions excluding the cylinder head side portions" mean the branch pipes and portions opposite to the cylinder head in the confluence.

Preferably, the thickness of the cylinder head side portion decreases in proportion to an increase of the distance between the cylinder head side portion and the middle of the longitudinal direction of the cylinder head, the thickness of each cylinder head side portion is larger than the thickness of each branch pipe extending to the cylinder head side portion, and the thickness of each branch pipe decreases in proportion to a decrease of the distance from the cylinder head to the branch pipe, so that the exhaust manifold can reduce the weight and the manufacturing cost by reducing the amount of material and can reduce the stresses transmitted to a flange integrally formed with the branch pipes and caused by the thermal expansion of the exhaust manifold.

Further, the present invention provides an exhaust manifold adapted for being mounted between a cylinder head and an exhaust pipe, comprising:

a plurality of branch pipes arranged in the longitudinal direction of the cylinder head and adapted for being connected to the cylinder head;

a confluence placed downstream of the plurality of branch pipes and adapted for being connected to the exhaust pipe, the plurality of branch pipes joining the confluence, the confluence having a plurality of junctions, each junction being formed with two adjoining branch pipes and provided with a cylinder head side portion facing toward the cylinder head; and the thickness of each cylinder head side portion being larger than the thickness of each branch pipe extending to the cylinder head side portion.

The exhaust manifold can reduce the weight and the manufacturing cost by reducing the amount of material and can reduce the stresses transmitted to a flange integrally formed with the branch pipes and caused by the thermal expansion of the exhaust manifold, because the thickness of each branch pipe is smaller than the thickness of each cylinder head side portion.

BRIEF DESCRIPTION OF THE DRAWINGS

The above and other objects, features and advantages of the present invention will be made more apparent from the following description of the preferred embodiments thereof in conjunction with the accompanying drawings wherein.

DESCRIPTION OF THE PREFERRED EMBODIMENTS

Figure 1:
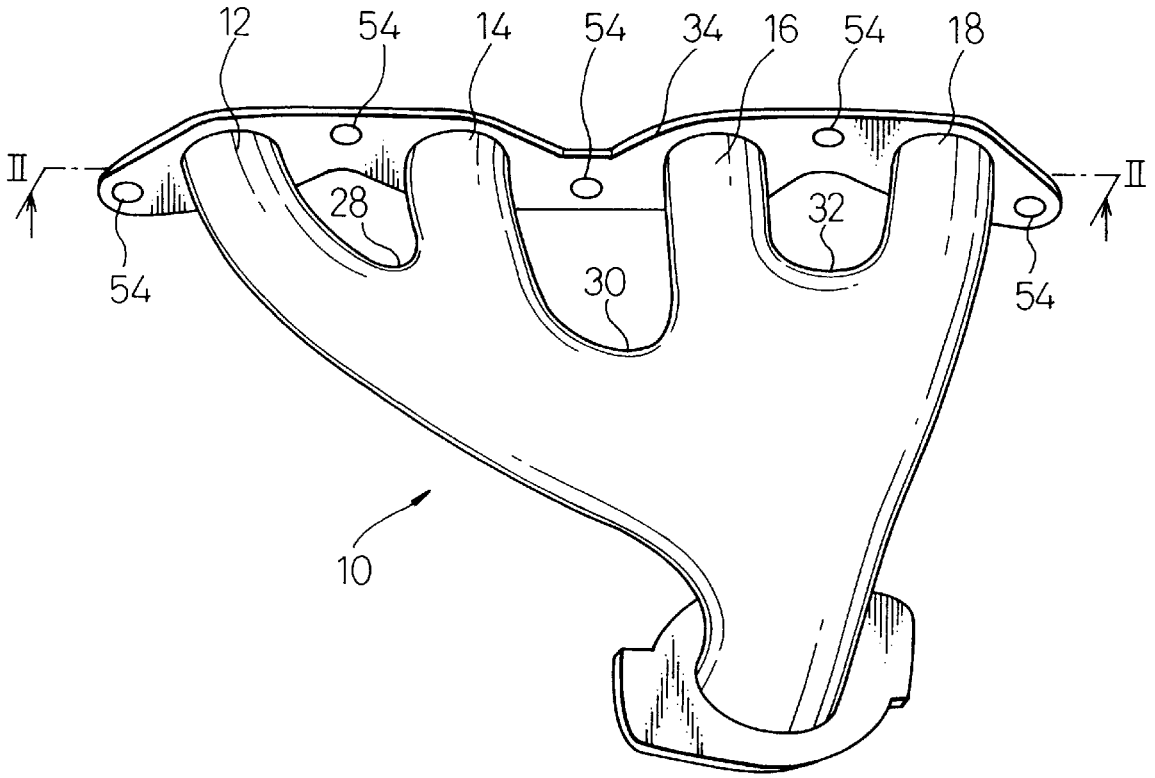
FIG. 1 is a perspective view of a first embodiment in which the present invention is applied to an exhaust manifold for a four cylinder engine.

FIG. 1 shows a perspective view of an exhaust manifold for four cylinder engine 10 of a first embodiment of an exhaust manifold according to the present invention. The exhaust manifold 10 has a flange 34 defining a plurality of bolt securing holes 54. The exhaust manifold 10 in FIG. 1 is secured to a cylinder head (not shown) arranged on the upper side of the exhaust manifold 10 with bolts (not shown) and is secured to an exhaust pipe (not shown) arranged on the lower side of the exhaust manifold 10 with securing means (not shown).

Figure 2:
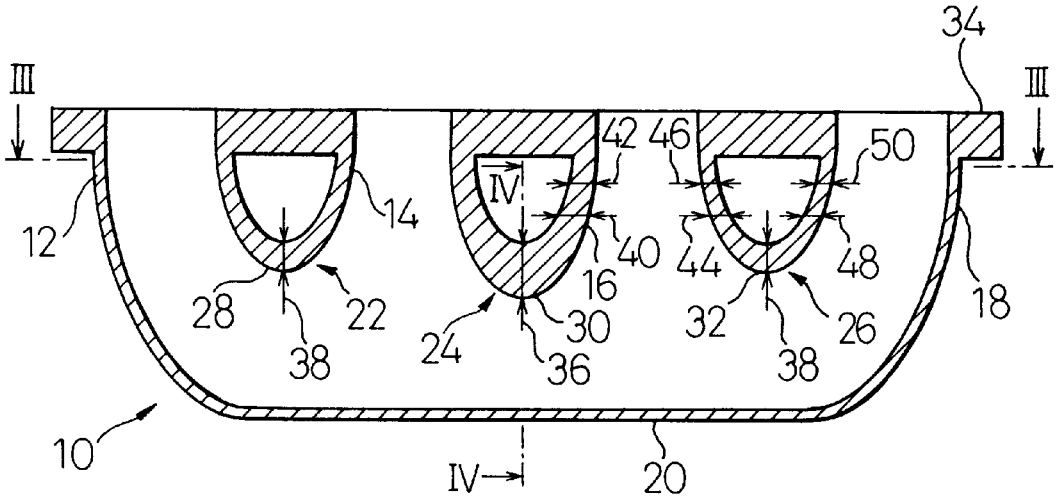
FIG. 2 is a cross-sectional view taken along line II—II in FIG. 1.
Figure 3:
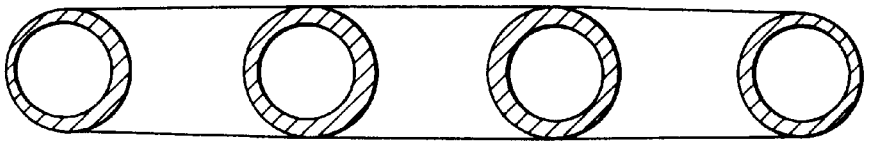
FIG. 3 is a cross-sectional view taken along line III—III in FIG. 2.
Figure 4:
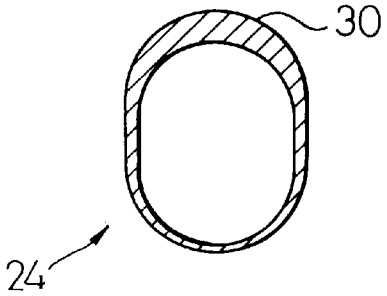
FIG. 4 is a cross-sectional view taken along line IV—IV in FIG. 2.

FIG. 2 shows a cross-sectional view taken along line II—II in FIG. 1, FIG. 3 shows a cross-sectional view taken along line III—III in FIG. 2, and FIG. 4 shows a cross-sectional view taken along line IV—IV in FIG. 2. As shown in FIGS. 1 to 4, the exhaust manifold 10 has four branch pipes 12, 14, 16, 18 arranged in the longitudinal direction (right-and-left direction in FIG. 2), and a confluence 20 placed downstream the branch pipes 12, 14, 16, 18. The branch pipes 12, 14, 16, 18 join the confluence 20 having three junctions 22, 24, 26. The junction 22 is formed with two adjoining branch pipes 12 and 14 and is provided with a cylinder head side portion 28 facing toward the cylinder head. The junction 24 is formed with two adjoining branch pipes 14 and 16 and is provided with a cylinder head side portion 30 facing toward the cylinder head. The junction 26 is formed with two adjoining branch pipes 16 and 18 and is provided with a cylinder head side portion 32 facing toward the cylinder head.

When the engine load and the temperature of an exhaust gas are high, the exhaust manifold 10 thermally expands and deforms, in particular, the temperature of the confluence 20 increases. However, since the flange 34 of the exhaust manifold 10 is secured to the cylinder head (not shown), the cylinder head side portions 28, 30 and 32 can freely thermally expand less than portions excluding the cylinder head side portions in the exhaust manifold 10, so that compressive stresses occur at the cylinder head side portions 28, 30 and 32. Now, "portions excluding the cylinder head side portions" mean the branch pipes 12, 14, 16 and 18 and portions opposite to the cylinder head in the confluence 20 (lower portions in the confluence 20 in FIG. 2).

In order to withstand the compressive stresses occurring at the cylinder head side portions 28, 30 and 32, the thicknesses 36 and 38 of the cylinder head side portions 28, 30 and 32 are larger than the thicknesses of the portions excluding the cylinder head side portions in the exhaust manifold 10. Therefore, the cylinder head side portions 28, 30 and 32 can sufficiently withstand the compressive stresses occurring at the cylinder head side portions 28, 30 and 32.

Further, as shown in FIGS. 1 to 4, since the right end or the left end of the confluence 20 is not secured to the cylinder head or the exhaust pipe (not shown), the exhaust manifold 10, especially the confluence 20 can expand and deform in the longitudinal direction (right-and-left direction in FIG. 2), so that the stresses concentrate less at the cylinder head side portions 28 and 32 than the cylinder head side portion 30. Therefore, the compressive stresses occur less at the cylinder head side portions 28 and 32 than the cylinder head side portion 30.

Figure 5:
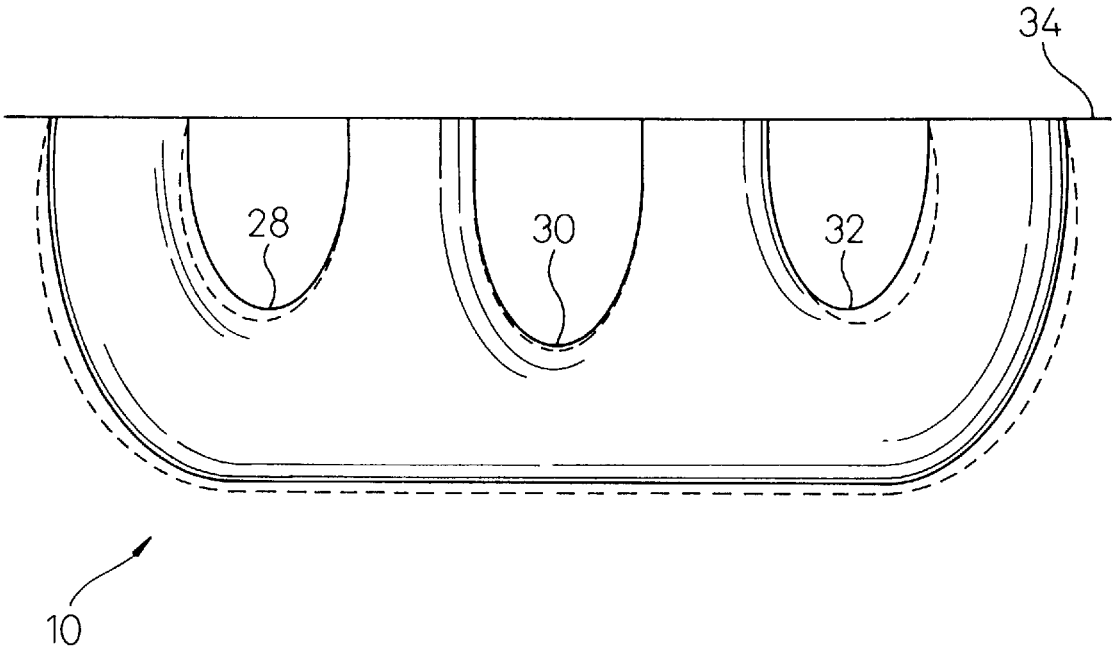
FIG. 5 is a schematic cross-sectional view of the exhaust manifold in FIG. 2 which is shown in solid line before it is thermally deformed and is shown in broken line after it is thermally deformed.

Regarding the above, the thickness 36 of the cylinder head side portion 30 arranged in the middle of the longitudinal direction of the cylinder head is the largest in all of the thicknesses 36 and 38 of the cylinder head side portions 28, 30 and 32. Therefore, the cylinder head side portion 30 having the largest thickness 36 can sufficiently withstand the largest compressive stress occurring at the cylinder head side portion 30, and the cylinder head side portions 28 and 32 having smaller thicknesses 38 than the thickness 36 can sufficiently withstand smaller compressive stresses occurring at the cylinder head side portions 28 and 32 than the compressive stress occurring at the cylinder head side portion 30. Further, the exhaust manifold 10 of the embodiment has less weight than the exhaust manifold of the prior art having the cylinder head side portions whose thicknesses are the same. FIG. 5 shows a schematic cross-sectional view of the exhaust manifold in FIG. 2 which is shown in solid line before it is thermally deformed and is shown in broken line after it is thermally deformed.

In general, the stress caused by the thermal expansion increases in proportion to an increase the cross-sectional area of a portion where the stress occurs, and the flange 34 integrally formed with the branch pipes 12, 14, 16 and 18 is secured to the cylinder head, so that the compressive stresses occurring at the branch pipes 12, 14, 16 and 18 increase in proportion to an increase the thicknesses 40, 42, 44, 46, 48 and 50 of the branch pipes 12, 14, 16 and 18.

Regarding the above, as shown in FIG. 2, the thickness of each cylinder head side portion is larger than the thickness of each branch pipe extending to the cylinder head side portion, that is, the thickness 36 is larger than the thickness 40, the thickness 38 is larger than the thickness 44, and the thickness 38 is larger than the thickness 48. Now, the exhaust manifold 10 shown in FIG. 2 is right-and-left symmetrical with respect to the junction 24. Further, the thickness of each branch pipe extending to each corresponding cylinder head side portion decreases in proportion to a decrease of the distance from the cylinder head to the branch pipe, that is, the thickness 40 is larger than the thickness 42, the thickness 44 is larger than the thickness 46, and the thickness 48 is larger than the thickness 50. Moreover, the thickness of the branch pipe decreases in proportion to an increase of the distance between the branch pipe and the middle of the longitudinal direction of the cylinder head, that is, the thickness 40 is larger than the thickness 44 which is larger than the thickness 48, and the thickness 42 is larger than the thickness 46 which is larger than the thickness 50. Therefore, the exhaust manifold 10 of the embodiment can reduce the stresses transmitted to the flange integrally formed with the branch pipes and caused by the thermal expansion of the exhaust manifold.

Further, it is preferable to decrease the thickness of the confluence 20 as far as the confluence 20 can withstand the stress occurring at the confluence 20 and caused by thermal expansion in the exhaust manifold 10. Therefore, the thicknesses of the portions excluding the cylinder head side portions 28, 30 and 32 are smaller than the thicknesses of branch pipes 12, 14, 16 and 18.

As well as the conventional exhaust manifold, the manifold 10 of the embodiment has recesses for securing the exhaust manifold 10 to the cylinder head with bolts which are secured to the cylinder head via the bolt securing holes 54 by a conventional tool. In general, the recesses are formed at sides of the confluence, and in this embodiment, the recesses are formed at the front side or the rear side of the confluence 20, that is, the recesses are formed at the portions excluding the cylinder head side portions. The conventional exhaust manifold is deformed to form the recesses since the thicknesses of the portions excluding the cylinder head side portions are unnecessarily large, therefore, the stresses occur and concentrate at the deformed portions in the conventional exhaust manifold. However, the exhaust manifold of the embodiment defines the recesses at the portions excluding the cylinder head side portions whose thickness is relatively small, therefore, the exhaust manifold of the embodiment does not have to be unnecessarily deformed, and the stresses caused by the deformation of the exhaust manifold occur and concentrate less in the exhaust manifold of the embodiment than the conventional exhaust manifold.

Figure 6:
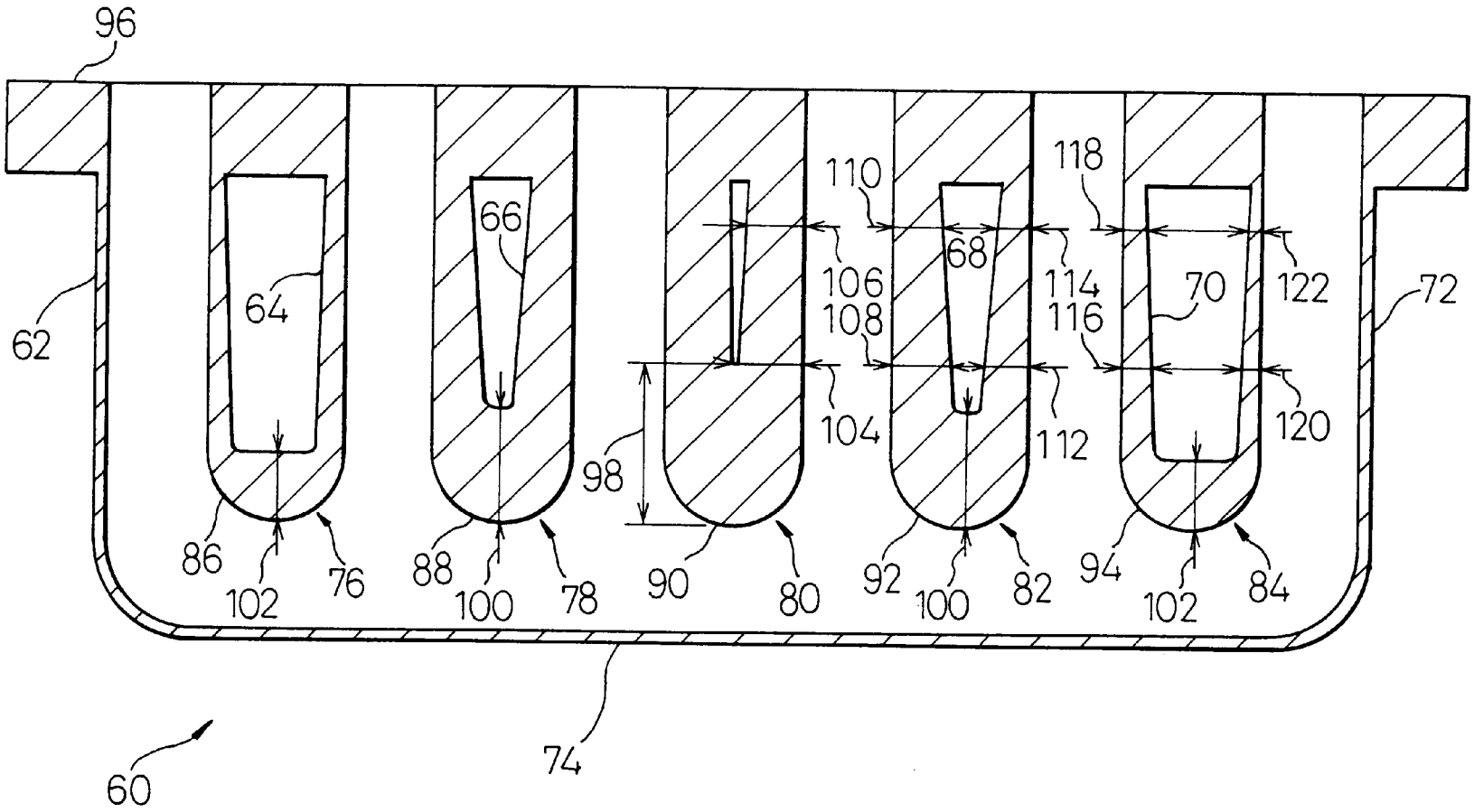
FIG. 6 is a schematic cross-sectional view of a second embodiment in which the present invention is applied to an exhaust manifold for a six cylinder engine.

FIG. 6 shows a schematic cross-sectional view of a second embodiment similar to FIG. 2, in which the present invention is applied to an exhaust manifold for a six cylinder engine. The exhaust manifold 60 has a flange 96 defining a plurality of bolt securing holes as well as the bolt securing holes 54 in FIG. 1.

As shown in FIG. 6, the exhaust manifold 60 has six branch pipes 62, 64, 66, 68, 70, 72 arranged in the longitudinal direction (right-and-left direction in FIG. 6), and a confluence 74 placed downstream the branch pipes 62, 64, 66, 68, 70, 72. The branch pipes 62, 64, 66, 68, 70, 72 join the confluence 74 having five junctions 76, 78, 80, 82, 84. The junction 76 is formed with two adjoining branch pipes 62 and 64 and is provided with a cylinder head side portion 86 facing toward the cylinder head. The junction 78 is formed with two adjoining branch pipes 64 and 66 and is provided with a cylinder head side portion 88 facing toward the cylinder head. The junction 80 is formed with two adjoining branch pipes 66 and 68 and is provided with a cylinder head side portion 90 facing toward the cylinder head. The junction 82 is formed with two adjoining branch pipes 68 and 70 and is provided with a cylinder head side portion 92 facing toward the cylinder head. The junction 84 is formed with two adjoining branch pipes 70 and 72 and is provided with a cylinder head side portion 94 facing toward the cylinder head.

When the engine load and the temperature of an exhaust gas are high, the exhaust manifold 60 thermally expands and deforms and, in particular, the temperature of the confluence 74 increases. However, since the flange 96 of the exhaust manifold 60 is secured to the cylinder head (not shown), the cylinder head side portions 86, 88, 90, 92 and 94 can freely thermally expand less than portions excluding the cylinder head side portions in the exhaust manifold 60, so that compressive stresses occur at the cylinder head side portions 86, 88, 90, 92 and 94. Now, "portions excluding the cylinder head side portions" mean the branch pipes 62, 64, 66, 68, 70 and 72 and portions opposite to the cylinder head in the confluence 74 (lower portions in the confluence 74 in FIG. 6).

In order to withstand the compressive stresses occurring at the cylinder head side portions 86, 88, 90, 92 and 94, the thicknesses 98, 100 and 102 of the cylinder head side portions 86, 88, 90, 92 and 94 are larger than the thicknesses of the portions excluding the cylinder head side portions in the exhaust manifold 60. Therefore, the cylinder head side portions 86, 88, 90, 92 and 94 can sufficiently withstand the compressive stresses occurring at the cylinder head side portions 86, 88, 90, 92 and 94.

Further, as shown in FIG. 6, since the right end or the left end of the confluence 74 is not secured to the cylinder head or the exhaust pipe (not shown), the exhaust manifold 60, especially the confluence 74 can expand and deform in the longitudinal direction (right-and-left direction in FIG. 6), so that the stresses concentrate less at the cylinder head side portions 86, 88, 92 and 94 than the cylinder head side portion 90. Therefore, the compressive stresses occur less at the cylinder head side portions 86, 88, 92 and 94 than the cylinder head side portion 90.

Regarding the above, the thickness 98 of the cylinder head side portion 90 arranged in the middle of the longitudinal direction of the cylinder head is the largest in all of the thicknesses 98, 100 and 102 of the cylinder head side portions 86, 88, 90, 92 and 94. Therefore, the cylinder head side portion 90 having the largest thickness 98 can sufficiently withstand the largest compressive stress occurring at the cylinder head side portion 90, and the cylinder head side portions 86, 88, 92 and 94 having smaller thicknesses 100 and 102 than the thickness 98 can sufficiently withstand smaller compressive stresses occurring at the cylinder head side portions 86, 88, 92 and 94 than the compressive stress occurring at the cylinder head side portion 90. Further, the exhaust manifold 60 of the embodiment can have less weight than the exhaust manifold of the prior art having the cylinder head side portions whose thicknesses are the same.

Further, the thickness of the cylinder head side portion decreases in proportion to an increase of the distance between the cylinder head side portion and the middle of the longitudinal direction of the cylinder head, that is, the thickness 98 is larger than the thickness 100 which is larger than the thickness 102.

In general the stress caused by the thermal expansion increases in proportion to an increase the cross-sectional area of a portion where the stress occurs, and the flange 96 integrally formed with the branch pipes 62, 64, 66, 68, 70 and 72 is secured to the cylinder head, so that the compressive stresses occurring at the branch pipes 62, 64, 66, 68, 70 and 72 increase in proportion to an increase the thicknesses 104, 106, 108, 110, 112, 114, 116, 118, 120 and 122 of the branch pipes 62, 64, 66, 68, 70 and 72.

Regarding the above, as shown in FIG. 6, the thickness of each cylinder head side portion is larger than the thickness of each branch pipe extending to the cylinder head side portion, that is, the thickness 98 is larger than the thickness 104, the thickness 100 is larger than the thickness 108, the thickness 100 is larger than the thickness 112, the thickness 102 is larger than the thickness 116, and the thickness 102 is larger than the thickness 120. Now, the exhaust manifold 60 shown in FIG. 6 is right-and-left symmetrical with respect to the junction 80. Further, the thickness of each branch pipe extending to each corresponding cylinder head side portion decreases in proportion to a decrease of the distance from the cylinder head to the branch pipe, that is, the thickness 104 is larger than the thickness 106, the thickness 108 is larger than the thickness 110, the thickness 112 is larger than the thickness 114, the thickness 116 is larger than the thickness 118, and the thickness 120 is larger than the thickness 122. Moreover, the thickness of the branch pipe decreases in proportion to an increase of the distance between the branch pipe and the middle of the longitudinal direction of the cylinder head, that is, the thickness 104 is larger than the thickness 108 which is larger than the thickness 112 which is larger than the thickness 116 which is larger than the thickness 120, and the thickness 106 is larger than the thickness 110 which is larger than the thickness 114 which is larger than the thickness 118 which is larger than the thickness 122. Therefore, the exhaust manifold 60 of the embodiment can reduce the stresses transmitted to the flange integrally formed with the branch pipes and caused by the thermal expansion of the exhaust manifold.

Further, it is preferable to decrease the thickness of the confluence 74 as far as the confluence 74 can withstand the stress occurring at the confluence 74 and caused by thermal expansion in the exhaust manifold 60. Therefore, the thicknesses of the portions excluding the cylinder head side portions 86, 88, 90, 92 and 94 are smaller than the thicknesses of branch pipes 62, 64, 66, 68, 70 and 72.

While the above description constitutes the preferred embodiment of the present invention, it will be appreciated that the invention is susceptible to modification, variation and change without departing from the proper scope and fair meaning of the accompanying claims.

What is claimed is:

1. An exhaust manifold adapted for being mounted between a cylinder head and an exhaust pipe, comprising:

a plurality of branch pipes arranged in the longitudinal direction of the cylinder head and adapted for being connected to the cylinder head;

a confluence placed downstream of the plurality of branch pipes and adapted for being connected to the exhaust pipe, the plurality of branch pipes joining the confluence, the confluence having a plurality of junctions, each junction being formed with two adjoining branch pipes and provided with a cylinder head side portion facing toward the cylinder head;

the thickness of each cylinder head side portion being larger than the thicknesses of portions excluding the cylinder head side portions in the exhaust manifold; and the thickness of the cylinder head side portion arranged in the middle of the longitudinal direction of the cylinder head being the largest in the thicknesses of all of the cylinder head side portions.

2. An exhaust manifold according to claim 1, wherein the thickness of the cylinder head side portion decreases in proportion to an increase of the distance between the cylinder head side portion and the middle of the longitudinal direction of the cylinder head, the thickness of each cylinder head side portion is larger than the thickness of each branch pipe extending to the cylinder head side portion, and the thickness of each branch pipe decreases in proportion to a decrease of the distance from the cylinder head to the branch pipe.

3. An exhaust manifold adapted for being mounted between a cylinder head and an exhaust pipe, comprising:

a plurality of branch pipes arranged in the longitudinal direction of the cylinder head and adapted for being connected to the cylinder head;

a confluence placed downstream of the plurality of branch pipes and adapted for being connected to the exhaust pipe, the plurality of branch pipes joining the confluence, the confluence having a plurality of junctions, each junction being formed with two adjoining branch pipes and provided with a cylinder head side portion facing toward the cylinder head; and the thickness of each cylinder head side portion being larger than the thickness of each branch pipe extending to the cylinder head side portion.

* * * * *